United States Patent [19]

Bennett

[11] 4,143,349

[45] Mar. 6, 1979

[54] CABLE DEPTH SELECTOR AND COIL SHUNT PENETRATOR

[75] Inventor: Derek J. Bennett, Thousand Oaks, Calif.

[73] Assignee: Bunker Ramo Corporation, Oak Brook, Ill.

[21] Appl. No.: 850,946

[22] Filed: Nov. 14, 1977

Related U.S. Application Data

[63] Continuation of Ser. No. 721,053, Sep. 7, 1976, abandoned.

[51] Int. Cl.[2] ..... B63B 21/52

[52] U.S. Cl. ..... 340/2; 9/8 R; 339/97 R

[58] Field of Search ..... 340/2; 9/8 R; 339/97 R

[56] References Cited

U.S. PATENT DOCUMENTS

| | | | |
|---|---|---|---|
| 2,802,083 | 8/1957 | Lapeyre | 339/97 R |
| 3,377,615 | 4/1968 | Lutes | 340/2 |
| 3,991,475 | 11/1976 | Segrest et al. | 340/2 |
| 4,062,614 | 12/1977 | Gressitt et al. | 339/97 R |

*Primary Examiner*—Richard A. Farley

*Attorney, Agent, or Firm*—F. M. Arbuckle; A. Freilich

[57] ABSTRACT

In a system for suspending an immersible package in water from a surface buoy with insulated electrical cable payed out from a coil in a pack attached to the descending package, a spring-biased braking arm on top of the pack is released to pivot against a center post (around which turns of coil are payed out) in response to a signal generated in the package at the required depth to brake descent of the package. Another signal generated in the package (after sufficient delay for the braking action to be completed) releases a spring-biased block against the cable in a guide just beyond the braking arm. The released block shoves the cable against conductive pins connected to a shunt lead from an electrical circuit in the package with sufficient force to cause the pins to penetrate the cable insulation. A viscous nonconducting material (coated on the cable to aid in holding turns of the coil in place in the pack until pulled as cable is payed out) is scraped off by the cable guide and accumulated around the penetrating pins to seal the connection between the pins and inner conductor of the cable after penetration.

13 Claims, 10 Drawing Figures

CABLE DEPTH SELECTOR AND COIL SHUNT PENETRATOR

This is a continuation, of application Ser. No. 721,053, filed Sept. 7, 1976.

BACKGROUND OF THE INVENTION

This invention relates to oceanic instrumentation systems, particularly expendable systems, where a wire cable is utilized to suspend an immersible package at some predetermined depth from a buoy and an insulated conductor usually inside the suspension cable is used to transmit signals between the immersible package and the buoy. The buoy usually contains radio equipment for communication with air or surface craft.

A sonobuoy is a typical expendable system which may employ the present invention to great advantage. It was developed as a submarine detector to be dropped from aircraft, but the preesnt invention is not limited to submarine detection applications. It is applicable to any instrumentation system for commerical or scientific applications. Consequently, although the present invention will be described in a specific embodiment with reference to a sonobuoy, it is not intended that the claims be limited to a sonobuoy.

An air-dropped sonobuoy assembly is comprised of a buoy and a battery-equipped instrumentation package. Attached directly to the instrumentation package is a cable pack which pays out cable as the instrumentation package and cable pack descend until the desired depth is reached. That depth is variable over a wide range and may be determined by a clock in the instrumentation package (which begins operation when the batteries are activated upon being immersed in seawater) from a known rate of descent. Alternatively, a pressure transducer in the instrumentation package may sense the desired depth pressure and stop the cable pack from paying out additional cable.

The cable which suspends the instrumentation package and cable pack is normally comprised of the insulated conductor through which the instrumentation package transmits data to the receiver/transmitter in the buoy. The insulated conductor is contained in a close-fitting jacket or casing of braided, high tensile strength synthetic aramid fiber. This outer braided material for the insulated conductor provides the necessary tensile strength required by the cable for the weight of the instrument package and cable pack in the water.

The cable in the pack is usually in excess of 16,000 feet in order for the same sonobuoy assembly to be used over a wide range of ocean depths. Consequently, there is usually a significant length of cable left coiled in the pack. This practice of providing excess cable for a particular mission presents two significant problems. The first problem is to provide a means for terminating the process of paying out cable. The second problem is to provide a means for shunting the coiled cable remaining in the pack. A solution to this second problem is significant because transmission through coiled cable remaining in the pack, plus the payed out length of cable, may require an extremely elaborate and expensive electronic transmitter and receiver to compensate for the poor frequency response and distortion of the coiled cable in the pack. Experience has demonstrated that transmission through the coiled cable in the pack is too complex and costly to develop, particularly when one must consider the large range of coiled cable that may remain in the pack. It is preferable to simply bypass the coiled cable in the pack, but that presents yet another problem of mechanically penetrating the cable insulation to achieve an electrical connection while maintaining a pressure seal around the connection thus made. The significance of this problem can be appreciated when it is recognized that the slightest leakage current from the electrical connection to the seawater will quickly erode the electrical connection by electrolysis.

SUMMARY OF THE INVENTION

In a system comprising a buoy and an immersible package connected to communicate electrical signals over a cable payed out to some selected depth from a coil having a total length greater than the selected depth, where the cable is comprised of a center conductor with insulation, apparatus for connecting an insulated shunt lead to the center conductor in the cable in order to bypass a signal from the remaining cable in the coil, comprising a driving spring and a block next to a cable guide through which the cable is being payed out and means for guiding the block in a motion against the block under the force of the spring. Means for releasably holding the block away from cable and against the spring holds the block stationary until activated by a releasing signal. At least one pointed pin is connected to the shunt lead with insulation throughout except for a length over its pointed end sufficient to penetrate the insulation of the cable to the center conductor. Means for holding the pin in a fixed position on a side of the cable opposite the block causes the cable to be impaled by the block when its holding means is activated. The cable is coated with nonconductive viscous material that is not soluble in water. This material, which aids in holding turns of the coiled cable in place until pulled off the coil a cable is payed out, is scraped off in sufficient quantity for a substantial amount of the material to be accumulated around the pin between the pin holding means and the spring-biased block. This material then aids isolating the penetrating pin and the insulated cable from the body of water after the block is released and the cable is penetrated.

As a further feature the coil is payed out from a cable pack and the cable penetrating apparatus is attached to the cable pack by means of a notched tab connected to the cable pack cooperating with a flanged disc connected to the block. The disk fits into the notch of the tab to hold the guiding means on the tab until the block is released, thus moving the disk out of the notch so the guiding means can slip off of the tab. In a preferred embodiment, the cable is payed out from a pack attached to the immersible package, and carries on its pay-out plate braking means to terminate the paying out of cable for the selected depth in response to a signal from the immersible package. After the braking signal has been transmitted, the releasing signal is generated.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
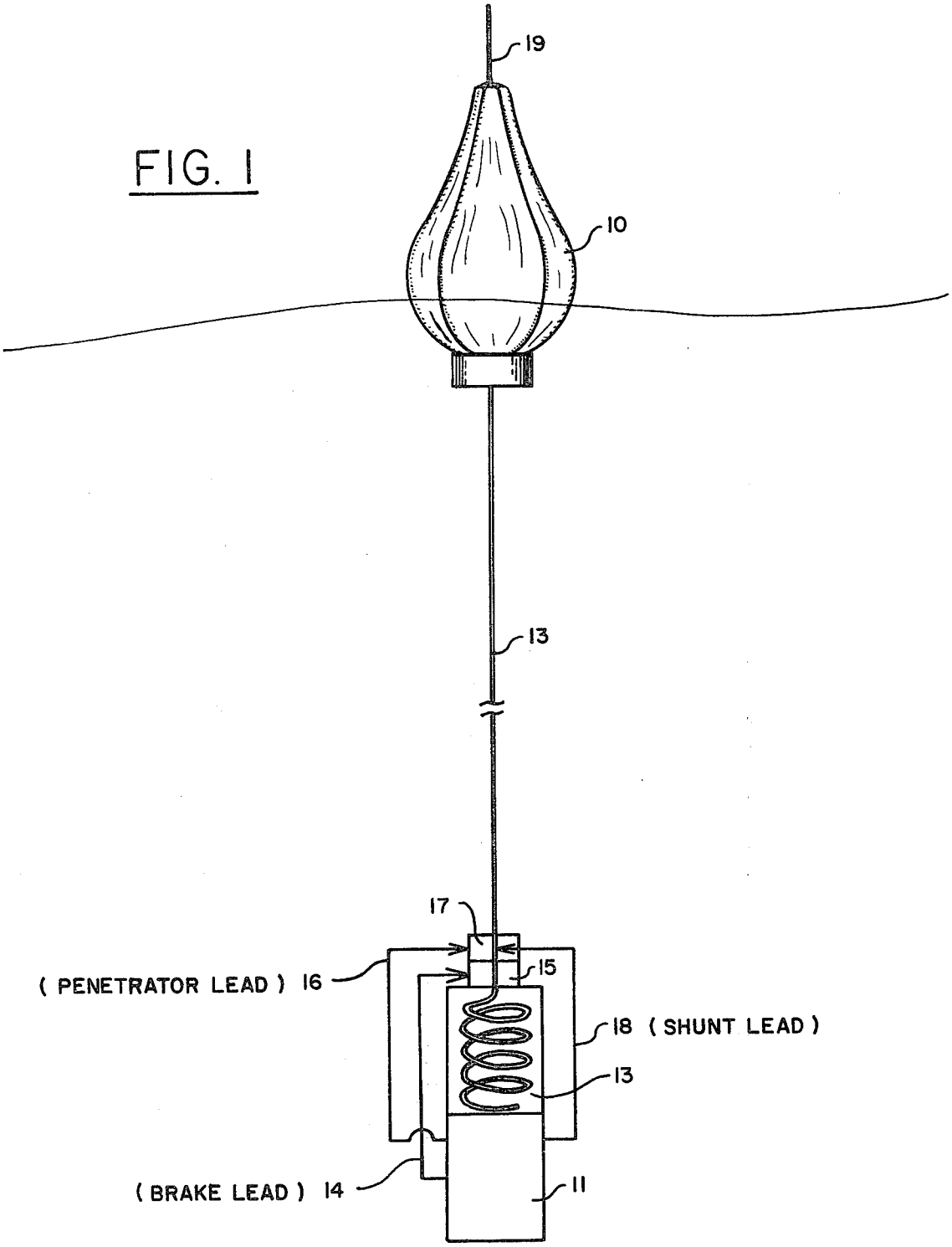
FIG. 1 is a schematic diagram illustrating the manner in which an electronic package is suspended from a buoy by a cable payed out from a coil in a cylinder to a predetermined depth and then braked with penetration of the payed-out cable for bypassing the remaining coiled cable in the cylinder by a shunt cable.

Referring now to FIG. 1 of the drawings, a buoy 10 is shown deposited or deployed in a body of water with an electronic instrumentation package 11, such as an acoustical detection system for transmitting through an insulated cable 12 data in respect to sounds detected by a hydrophone. The cable is payed out from a coil pack 13 as the package 11 descends, as will be described in greater detail hereinafter.

The package 11 contains seawater-activated batteries which not only energize electronic circuits for transmitting data to the buoy through the cable, but also energize circuits for selecting the depth (payed-out cable length) according to some predetermined criteria, such as descending time after energization or water pressure. Once the payed-out cable length is selected, an insulated brake lead 14 is energized to actuate a braking mechanism 15. After a predetermined delay, as determined by a clock pulse counter in the package 11, an insulated penetrator lead 16 is energized to actuate a mechanism 17 which causes an insulated shunt lead 18 to electrically connect the payed-out cable 12 to the end of the cable in the pack 13, or to effectively connect the payed-out cable directly to the signal output of the package 11. In that manner, signals transmitted to a receiver/transmitter in the buoy bypass the remaining cable in the pack 13. The receiver amplifies the signal and codes it for transmission through an antenna 19.

Figure 2:
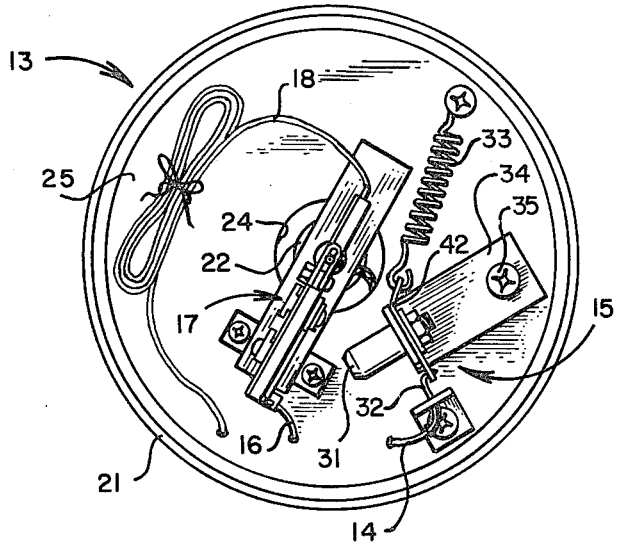
FIG. 2 is a top view of a cable pack showing the arrangement of cable braking and coil shunting mechanisms.
Figure 3:
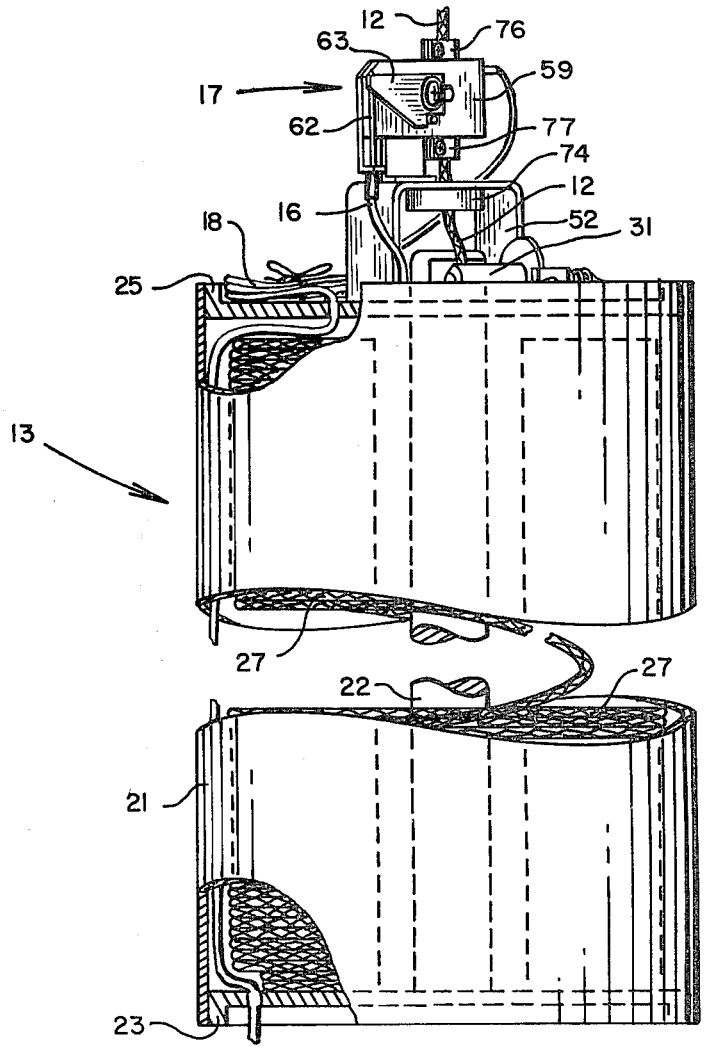
FIG. 3 is a side view of the coil pack shown in FIG. 2 partially broken away to show the coiled cable, and showing the arrangement of the cable braking and coil shunting mechanisms in elevation.
Figure 4:
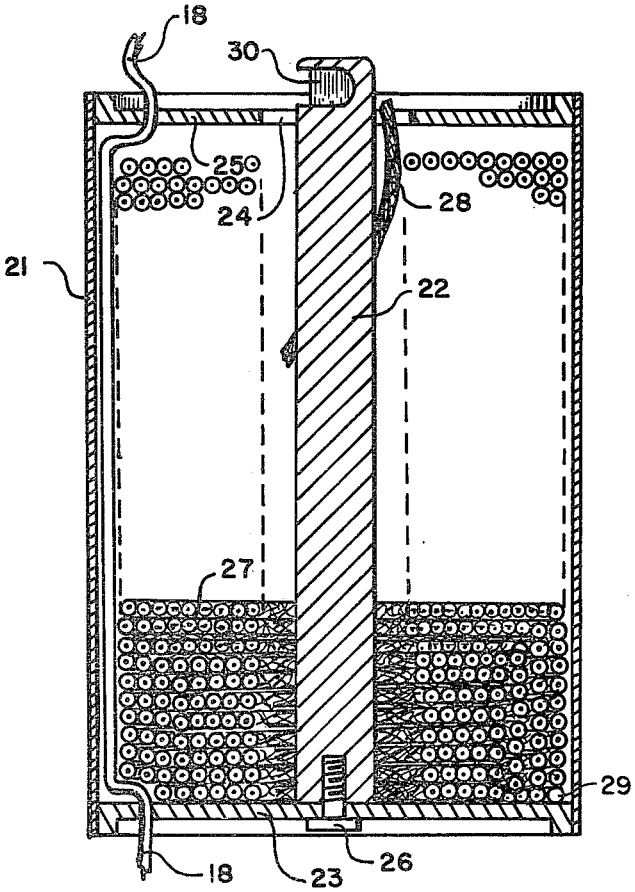
FIG. 4 is a sectional view of just the cable pack of FIGS. 1 and 2.

The arrangement and operation of the cable pack 13, braking mechanism 15 and the cable penetrating mechanism 17 will now be described with reference to the remaining figures. FIGS. 2 and 3 illustrate respective top and side views of the cable pack 13 comprised of a hollow aluminum cylinder 21, a post 22 extending from a base plate 23 through a hole 24 in a pay-out plate 25. FIG. 4 illustrates the relationship of the post (secured to the base plate 23 by a bolt 26) to the hole 24 in the pay-out plate 25, and also illustrates the manner in which at least 16,000 feet of coiled cable 27 is placed inside the cylinder with the end 28 of the cable on the first inside turn extending through the pay-out hole 24 and the opposite end 29 of the cable extending through the base plate 23. The coiled cable is so placed in the cylinder as to cause the pay-out end 28 of the cable to move around the post counterclockwise (CCW) as viewed in FIG. 1.

The post is provided with a cavity 30 of a full radius equal to the radius of an arm 31 (FIG. 2) which engages the post when a fusible link 32 is fused by current from the circuit package 11 via an insulated lead 14. Once the link is fused, a spring 33 pivots an L-shaped bracket 34 (which carries the arm 31) about the axis of a screw 35. The force of the spring need be only sufficient to move the arm into engagement with the cutout 30 of the post 22. In that position, the centerline of the arm is approximately tangent with the post. Since the pivot of the arm is in the tangential direction in which the cable is unwinding as it is being payed out from the cylinder, the next turn of the cable to pass out of the cylinder through hole 24 in the pay-out plate will pass over the arm 31. To facilitate this, the end of the arm is chamfered as shown. This will stop the cable from unwinding in a CCW direction as viewed in FIG. 3 and cause the next several turns to be tightened around the post while a predetermined amount of cable continues to slip over the arm.

The friction of the tightly wrapped turns against the post will brake the descent of the cable pack and electronic package. Since this frictional force develops gradually over a period of about 7 seconds, the descending mass is decelerated to a smooth stop. The nominal rate of descent being known in advance of deploying the buoy and electronic package, it is possible to anticipate the time of descent at which the link 32 is to be fused. Seven seconds later, as determined by an electronic clock in the electronic package, the mechanism 17 (FIG. 1) is actuated by a signal transmitted by the electronic package 11 to cause the shunt lead 18 to be connected to the payed-out cable 12 very near the exit point of the cable pack.

All of the leads 14, 16 and 18 from the electronic circuit pass through the cable pack between the outside of the coiled cable and the cylinder wall of the pack, as shown in FIG. 4 for the lead 18. They are shown in FIG. 2 as being external merely for the purpose of describing the general organization of the buoy, cable pack and electronic package assembly. The shunt lead 18 passing through the base plate 23 is connected to the signal output terminal of the electronic package. The end 29 of the coiled cable is unconnected and insulated. Alternatively, the inner conductor of the lead 18 from the electronic circuit in the package 11 (FIG. 1) and of the end 29 of the cable may be spliced inside the cylinder 21. In either case, once the mechanism 17 has been actuated, the uncoiled cable in the pack is shunted.

To assure that once connected to the cable 12 the lead 18 remains connected and is not pulled off or parted by any additional length of cable slipping past the arm 31 in the slot 30 (FIG. 3), the lead 18 is made extra long. The excess length of the lead is folded and tied to the pay-out plate with string of such low tensile strength that the folded length of lead easily breaks loose and unfolds. To be certain that it does unfold, in order to regard the lead 18 as a conductor having only a known resistance, and virtually no reactance, the firing of the mechanism 17 may be timed to occur shortly before the cable pack is expected to come to a final stop. The excess length, now extended in a loop floating freely in the water, will permit some maximum slippage of cable past the braking arm 31, which maximum can be empirically determined.

Figure 5:
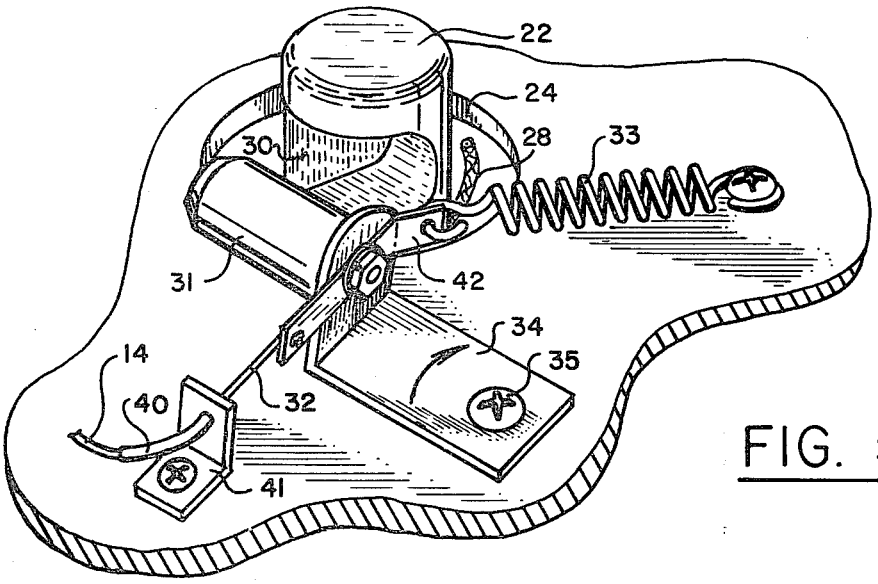
FIG. 5 is an isometric view of just the cable braking mechanism of FIGS. 2 and 3.

Before describing the penetrating mechanism 17 in detail, the manner in which the insulated fusible link 32 is mechanically connected to the bracket 34 will be described with reference to FIG. 5. The insulated brake lead 14 is terminated in a sleeve 40 inside of which the end of the insulated link 32 is soldered. The ends of the sleeve 40 are sealed. Then the insulated link 32 is passed through a hole in a bracket 41 which is large enough to pass only the insulated link, which is a short length of wire made of an alloy of known fusible characteristic. The soldered connection and sleeve 40 thus secure one end of the link to the bracket 41 while the other end of the link, stripped of insulation, is passed through a hole in a double-arm bracket 42 and soldered. To assure that the solder connection will hold, the link wire may be bent around the bracket before soldering. The bracket serves as circuit ground for the braking signal transmitted through the fusible link via the lead 14. The insulation around the link wire assures that all of the braking signal passes through the link, and provides sufficient thermal insulation to assure that the link will fuse for the braking signal current, even in the lowest water temperatures anticipated. The second arm of the bracket 42 is connected to the spring 33 which is under sufficient tension to move the bracket 34 clockwise about the pivot 35 and thus bring the braking arm 31 into engagement with the post 22.

Figure 8:
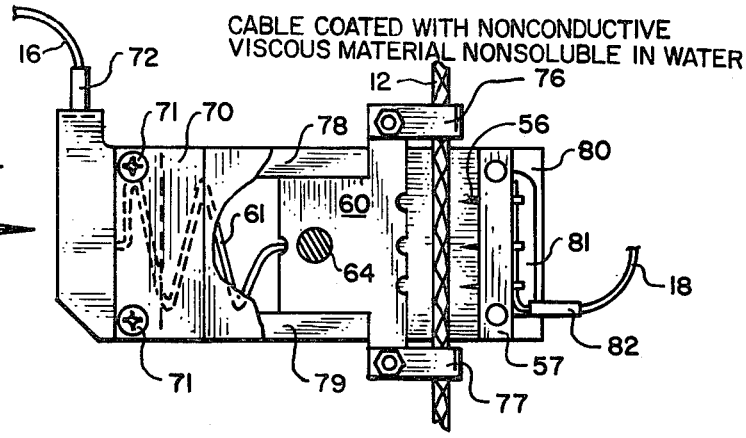
FIGS. 6, 7 and 8 are top, front and rear views of just the cable shunting mechanism of FIGS. 2 and 3.
Figure 6:
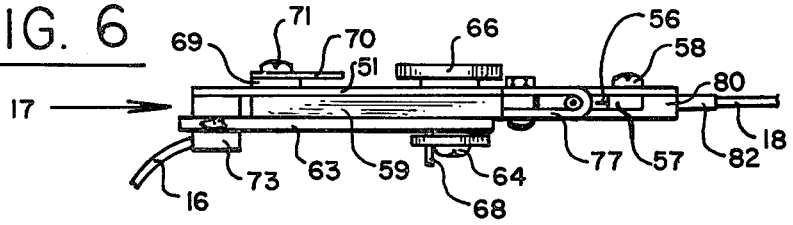
Figure 7:
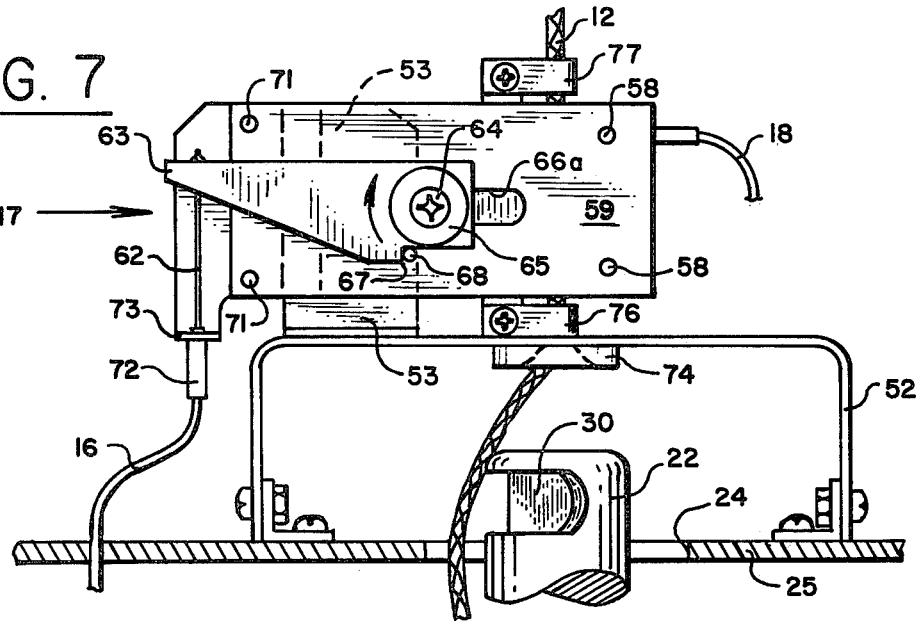
Figure 10:
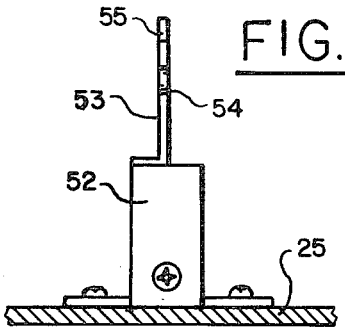
FIGS. 9 and 10 are front and side views of just a mounting bracket for the mechanism of FIGS. 6, 7 and 8.

The penetrating mechanism 17 will now be described with reference to FIGS. 6, 7 and 8. FIG. 6 shows the mechanism as viewed from the top, which is the view of that mechanism shown in FIG. 2; FIG. 7 shows the mechanism from the front, which is the side shown in the isometric view of that mechanism in FIG. 3; and FIG. 8 shows the mechanism from the back. It should be noted that in presenting this rear view, the mechanism shown in FIG. 6 has been rotated 90° about a horizontal axis. In addition, part of the mechanism, a rear guide plate 51, has been broken away in order to show some of the detail of construction. It should also be noted that a mounting bracket 52 secured to the pay-out plate 25 is shown in FIG. 7, but omitted in FIGS. 6 and 8. The mounting bracket 52 is shown in front and side elevation by itself in respective FIGS. 9 and 10 in order to show a tab 53 with a notch 54 and a chamfered corner 55 onto which the mechanism 17 is placed, as shown in FIG. 7.

Figure 9:
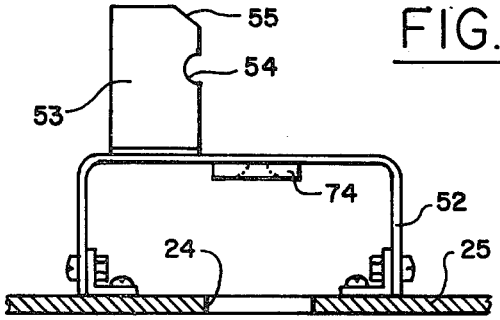

The essential parts of the penetrating mechanism are shown in FIG. 8 as follows: one or more pins 56 set in a block 57 of nylon and held in place by screws 58 passing through holes in the guide plate 51, and holes in the block 57 (the screws 58 are threaded into a body 59 that effectively forms a second guide plate parallel to the first guide plate 51); a block 60 having notches cut out on one side facing the pins 56 (which penetrate the insulation of the cable 12 when the block moves to the right, as viewed in FIG. 8, to impale the cable on the pins); a spring 61 between the back plate 51 and the body 59 to move the block 60 to the right; and means for releasably holding the block in the position shown in FIG. 9 until a fusible link 62 is fused by a signal transmitted by the electronic package 11 over a lead 16 (FIG. 1). The pins are preferably goldplated stainless steel.

The means for releasably holding the block is comprised of a latching lever arm 63 pivoted on a screw 64 passing through a washer 65 and the lever arm. The screw is threaded into a flanged disc 66. A slot **66*a* in the body 59, and a corresponding slot in the back plate, allow the block 60 to move to the right when the link 62 is fused. Until then, a shoulder 67 on the lever arm rests against a rigid pin 68 extending from the body 59, as shown in FIG. 7. That pin is shown in FIG. 6** with an exaggerated length; in practice it extends out from the body only to a point even with the surface of the lever arm.

Once the link 62 is fused, the lever arm is free to pivot in the slot **66*a* about the center of the screw 64. The distance from that center to the pin 68 and the force of the compressed spring provides sufficient torque to cause the lever arm to pivot. As the lever arm pivots, the block begins to move forward until the shoulder of the lever arm clears the pin. The compressed spring then accelerates the block with sufficient force to cause the pins 56 to impale the cable 12. Once that has occurred, any further length of cable payed out will cause the penetrating mechanism to rise on the tab 53. Until then, the mechanism is locked in place against a shim 69 which spaces a wide strip 70 of metal out a distance from the back plate 51 sufficient to allow the tab 53 to be slipped in between the wide strip 70 and the back plate. Screws 71 threaded into the body 59 hold the shim and wide strip in place. The flanged disc 66 is thus held against the slot 54 (FIG. 9) of the tab 53 to secure the mechanism on the tab 53** until the flanged disc is carried to the right by the force of the spring.

The fusible link 62 is prepared in the same manner as the link 32 for the brake mechanism. A sleeve 72 is slipped over a soldered connection between a length of insulated alloy having the necessary fusible characteristic. The sleeve is sealed at both ends and the insulated alloy which constitutes the fusible link is inserted through a hole in an ear 73 large enough to pass only the insulated alloy. The other end of the insulated alloy is stripped and passed through a hole in the end of the lever arm. Solder on the tip of the alloy secures it to the lever arm. Once again, the alloy may be bent over the lever arm before soldering.

Secured to the underside of the bracket 52 is a disc 74 with a hole centered directly over the axis of the post 21. A radius is machined around the hole 75 as shown to avoid abrading the insulation of the cable 12. As the loops of coiled cable pass out through the hole 24 in the pay-out plate 25, the cable moving past the end of the post 21 moves around the post counterclockwise.

The cable is a single conductor typically consisting of seven hard-drawn 36 AWG tin-plated copper wires in a right-hand lay construction, and insulated with a continuous thin (0.010 inch) jacket. The insulated conductor is contained in a continuous and tight-fitting braided casing. The braided casing is made of a non-conductive fiber of high tensile strength, e.g., a fiber in which the fiber-forming substance is any long chain synthetic polymer, and preferably of 1000-denier KEVLAR 29 braided in a one-over-one construction. The casing is sufficiently tight to completely contain the insulated conductor under normal flexing, and particularly under the conditions required by the cable pack for stowage and payout of the cable. The braided casing is lightly impregnated with a coating that will provide a fiber-to-fiber bond, prevent unraveling and enhance the handling properties of the finished cable.

The cable is wound into the pack cylinder in a clockwise direction such that the payout is from the center of the winding, in a CCW direction as noted hereinbefore. To prevent over-dispensing of turns of the cable winding as cable is payed out, the cable is coated with a non-water-soluble viscous material such as grease or wax. Much of this coating will be scraped off as the cable is payed out through the penetrating mechanism. After some minimum length of cable has been payed out, the space between the back plate 51 and the body 59, and between the block 60 and the pin securing block 57, will be substantially filled with the coating material. Consequently, when the block is released, it compresses the viscous material between the cable and the pin-securing block. This assures a water-tight seal around the pins penetrating the insulation of the cable to prevent any current leakage around the pins into the sea-water. Such leakage would quickly erode the pins by electrolysis.

To keep the cable spaced away from the pins 56 until the block is released, metal straps 76 and 77 around the cable are secured to ears on the block as shown. The body is formed with internal side rails 78 and 79 (FIG. 8) which terminate just behind the block 60 in the latched position shown, thus leaving slots between the body 59 and back plate for the ears of the block to slide forward when the block is released. While the strap 77 will strip some of the non-water-soluble viscous material, experience has shown that enough more is stripped by the strap 76 to fill the space between the block 60 and the pin block 57.

The body 51 is also provided with an end rail 80 against which the pin block 57 is secured. A cavity 81 is provided in the end rail 80 to receive the soldered connections between the inner conductor of the shunt lead 18, and a slot is provided to receive a reinforcing and sealing sleeve 82 over the insulated shunt lead where it passes into the cavity 81. Before the back plate 51 is fastened on, the cavity is filled with insulating material, such as epoxy.

Although particular embodiments of the invention have been described and illustrated herein, it is recognized that modifications and equivalents may readily occur to those skilled in the art. Consequently it is intended that the claims be interpreted to cover such modifications and equivalents.

The embodiments of the invention in which an exclusive property or privilege is claimed are described as follows:

1. In a system for suspending an immersible package in a body of water from a surface buoy at some selected depth, said system having an insulated signal cable payed out from a coil as said package descends to provide a center conductor with electrical insulation for communicating electrical signals between said buoy and said immersible package, said coil having a total length greater than said selected depth; apparatus for connecting an insulated shunt lead to said center conductor in said cable in order to bypass remaining cable coiled in said coil, an improvement comprising a driving spring and a block next to a cable guide through which said cable is being payed out, and means for guiding said block in a motion against said cable under the force of said spring; means for releasably holding said block away from said cable and against said spring; at least one pointed pin connected to said shunt lead with electrical insulation throughout except for a length at a pointed end thereof sufficient for the pin to penetrate said electrical insulation around said center conductor and contact said center conductor; means for holding said pin in a fixed position on a side of said cable opposite said block; and means for activating said block holding means to release said block for motion against said cable to impale said cable on said pin.

2. The combination of claim 1 including nonconductive viscous material on said cable, said viscous material being nonsoluble in water and in sufficient quantity for a substantial amount of said material to be scraped off of said cable and accumulated around said pin between said pin holding means and said block as said cable is payed out, thus isolating said pin penetrating said insulated cable from said body of water with nonconductive material after said block is released.

3. The combination of claim 2 including a penetrator signal lead connected between said immersible package and said means for holding said block back from said cable to conduct a penetrator signal generated in said immersible package, and wherein said means for holding said block back from said cable against said block-driving spring is comprised of a lever arm and cylindrical means for securing said lever arm to said block, said lever arm being pivoted on the axis of said cylindrical securing means, a pin fixed in position relative to said guides and offset from said axis in a direction approximately normal to the direction of motion of said block under the force of said block-driving spring, said lever arm having a shoulder in engagement with said pin, and linking means connected between the end of said lever arm and a fixed bracket and connected to said penetrator signal lead for securing said lever arm in position until activated by said penetrator signal.

4. In a system for suspending an immersible instrumentation package in a body of water from a surface buoy with cable payed out from a coil around a post in a pack attached to said instrumentation package, wherein said coiled cable is an insulated conductor for instrumentation signals, the combination comprising at least one guide around said cable being payed out, at least one conductive pin, insulating means for fastening said pin to said guide with a pointed end thereof pointing to approximately the center of said cable, an insulated instrumentation signal lead connected through said insulating means to said conductive pin to provide electrical continuity to said pin from said instrumentation package, a block and a block-driving spring mounted on a support for said guide, said block-driving spring being pressed against said block to force it to move against said cable in a direction in line with the pointed end of said pin, an insulated lead for conducting a penetrator signal from said instrumentation package, means for holding said block away from said cable against the force of said block-driving spring until activated by said penetrator signal from said instrumentation package to release said block and impale said cable on said pin, thereby providing electrical continuity between said signal lead and said conductive cable at a point just past the end of said post around which said coiled cable is payed out.

5. The combination of claim 4 including two cable guides, one above and one below said block, and including nonconductive viscous material on said cable, said viscous material being nonsoluble in water and in sufficient quantity for a substantial amount of said material to be scraped off of said cable and accumulated in and around said pin between said guides as said cable is payed out, thus isolating said pin penetrating said insulated cable from said body of water with nonconductive material after said block is released by said means for holding said block when activated by said penetrator signal.

6. The combination of claim 5 wherein said means for holding said block back from said cable against said block-driving spring is comprised of a lever arm and cylindrical means for securing said lever arm to said block, said lever arm being pivoted on the axis of said cylindrical securing means, and wherein said conductive pin is fixed in position relative to said guides and offset from said axis in a direction approximately normal to the direction of motion of said block under the force of said block-driving spring, said lever arm having a shoulder in engagement with said conductive pin, and linking means connected between the end of said lever arm and a fixed bracket, and connected to said penetrator signal lead for securing said lever arm in position until activated by said penetrator signal.

7. The combination of claim 6 wherein said linking means is a link of fusible material, one end of said link being uninsulated and the length of said link to the other end being insulated, and connected at said other end to said insulated penetrator signal lead through an insulated connection.

8. In a system comprising a buoy containing electronic equipment connected to receive a signal over an insulated conductor cable from an instrumentation package immersible in water, said package containing an electronic circuit for transmitting a signal to said buoy over said cable, and a cable pack attached to said package for storing a coiled cable comprised of a center conductor in a close-fitting, fiber-reinforced electrical insulating casing, the improvement comprising:

a loop of insulated conductor, one end of the loop being connected to receive a signal from the electronic circuit in said instrumentation package and the other end being connected to at least one sharp pin, all of the pin being insulated except a point thereof, a sufficient length of said point being uninsulated to penetrate the cable to the center conductor;

a block spring-biased to move in a direction toward and in line with the pointed end of the pin;

locking means for preventing the block from moving until released in response to a penetrator signal from said immersible package;

means for guiding the cable being payed out from the pack in a line between the block and the pin, said guiding means holding both the spring-biased block and pin in a fixed positional relationship to each other with the cable in between; and means responsive to said penetrator signal for releasing said locking means to release said block for motion against the cable to impale the cable on the pointed end of said pin.

9. The improvement defined by claim 8, wherein said guiding means is attached to said cable pack by means of a notched tab connected to said cable pack, and a flanged disk connected to said block, said disk fitting into said notch of the tab to hold said guiding means on said tab until said block is released and moves away from said tab, thus moving the disk out of the notch so the guiding means can slip off of the tab.

10. The improvement defined by claim 9 wherein said cable pack is comprised of a cylindrical container having a base plate and a top plate, said top plate having a hole in the center thereof, a post extending from said base plate and through the center of a coil of cable to and through said hole in said top plate, a spring, a braking arm pivotally secured to said top plate and biased against said post by said spring, the pivot for said arm being selected to be in a tangential direction consistent with the angular direction of unwinding of turns of said cable coiled around said post, a link and a bracket, said link connected between said bracket and said braking arm to hold said braking arm initially in a position away from said center post, said link being made of an insulated fusible material, a conductive lead from the immersible package connected to said link to conduct sufficient current to fuse the link in response to a signal from said instrumentation package generated when the required length of cable has been payed out for a desired depth, thus causing said spring-biased arm to engage said center post, thereby preventing the next turn of the cable from being payed out and causing the next few turns of cable to wrap tightly around said post as cable slips over the arm to gradually brake the descent of said cable pack and immersible package.

11. The improvement defined by claim 10, wherein said pin is held by a block of insulating material, and said coiled cable is coated with a viscous material that is not soluble in water, and that is not electrically conductive, to aid in holding the turns of coiled cable in place in said pack until the turns are pulled off as cable is payed out, and wherein some of said viscous material is scraped off as the cable passes between said pin and said block, whereby viscous material scraped off builds up in the channel between the pin and the spring-biased block so that when the cable insulation is penetrated by said pin, viscous material is compressed between said spring-biased block and the pin-holding block to seal the penetrating pins against any current leakage.

12. The improvement defined by claim 10 wherein said spring-biased block is secured to said top plate by releasable means for locking said spring-biased block to said top plate until the spring-biased block is released to cause the cable to be penetrated.

13. In a system comprising a buoy containing electronic equipment connected to receive a signal over an insulated conductor cable payed out from a cable pack in an instrumentation package immersible in water, said package containing an electronic circuit for transmitting a signal to said buoy over said cable, said cable pack being attached to said package for storing a coiled cable comprised of a center conductor encased in electrical insulation, the improvement comprising:

a segment of insulated conductor having one end connected to receive a signal from the electronic circuit in said instrumentation package and the other end being connected to at least one sharp pin, all of the pin being insulated except a point thereof of sufficient length to penetrate the cable to the center conductor;

means for guiding the cable being payed out from said cable pack along a prescribed path;

means supporting said sharp pin adjacent to and in alignment with said prescribed path;

means for generating a penetration command signal, and means responsive to said penetration command signal for impaling said cable on the pointed end of said pin.

* * * * *